US006058286A

United States Patent [19]

Park

[11] Patent Number: 6,058,286

[45] Date of Patent: May 2, 2000

[54] TRANSFER UNIT OF ELECTROPHOTOGRAPHIC PRINTER

[75] Inventor: Woo-yong Park, Suwon, Rep. of Korea

[73] Assignee: Samsung Electronics Co., Ltd., Kyungki-do, Rep. of Korea

[21] Appl. No.: 09/362,677

[22] Filed: Jul. 29, 1999

[30] Foreign Application Priority Data

Jul. 31, 1998 [KR] Rep. of Korea ..... 98-31167

[51] Int. Cl.[7] ..... G03G 15/16

[52] U.S. Cl. ..... 399/307; 399/121

[58] Field of Search ..... 399/121, 122, 399/297, 308, 307, 302, 320, 328

[56] References Cited

U.S. PATENT DOCUMENTS

| | | | |
|---|---|---|---|
| 4,541,709 | 9/1985 | Kampschreur | 399/162 |
| 5,150,161 | 9/1992 | Bujese | 399/308 |
| 5,374,982 | 12/1994 | Boockkholdt | 399/318 |
| 5,940,671 | 8/1999 | Kim | 399/318 |
| 5,956,553 | 9/1999 | Park | 399/307 |

FOREIGN PATENT DOCUMENTS 58-105268 6/1983 Japan .

*Primary Examiner*—Robert Beatty

*Attorney, Agent, or Firm*—Sughrue, Mion, Zinn, Macpeak & Seas, PLLC

[57] ABSTRACT

A transfer unit of an electrophotographic printer, includes a base frame; a first lever which is pivotally installed at the base frame, and by which a transfer roller is supported, the transfer roller rotating while closely contacting a photosensitive belt and to which an image on the photosensitive belt is transferred; and a second lever which is pivotally installed at the base frame, and by which a fixing roller is supported, the fixing roller pressing a paper passing through between the transfer roller and the fixing roller against the transfer roller while rotating in contact with the transfer roller, and fixing an image on the transfer roller onto the paper. A first elastic biasing mechanism is provided for elastically biasing the first lever and the second lever so that the transfer roller and the fixing roller can be separated from each other; a second elastic biasing mechanism is provided for elastically biasing the first lever so that the transfer roller can separate from the photosensitive belt; and a wire is provided one end of which is fixed to a winding gear rotatably installed at the base frame, and the other end of which is fixed to the first lever, and which is connected to the first lever and the second lever so that the transfer roller and the fixing roller, and the photosensitive belt approach each other while overcoming the elastic biasing forces of the first and second elastic biasing mechanisms.

5 Claims, 3 Drawing Sheets

TRANSFER UNIT OF ELECTROPHOTOGRAPHIC PRINTER

BACKGROUND OF THE INVENTION

1. Field of the Invention

The present invention relates to a transfer unit of an electrophotographic printer and, more particularly, to a transfer unit of an electrophotographic printer having an improved structure for establishing contact or separation between a transfer roller and a fixing roller between which a paper passes through for printing an image on the paper.

2. Description of the Related Art

As shown in FIG. 1, an electrophotographic printer such as a color laser printer includes a photosensitive belt 10 traveling along a circular path, a developing unit 20 for developing a desired image on the photosensitive belt 10, and a transfer unit 30 for printing the image developed on the photosensitive belt 10 by the developing unit 20.

The transfer unit 30 includes a transfer roller 31 to which the image developed on the photosensitive belt is transferred and which prints the transferred image on one surface of a paper 1, a fixing roller 32 which presses the paper 1 against the transfer roller 31 while rotating in contact with the transfer roller 31, first and second levers 34 and 35 which support the transfer roller 31 and the fixing roller 32, respectively, and pivot around a hinge shaft 33*a,* and pivoting means for pivoting the first and second levers 34 and 35.

The pivoting means includes a first screw 38 which passes through the first lever 34 and is fixed to a base frame 33, a first compression spring 38*a* which is installed around the circumferential surface of the first screw 38 and presses the first lever 34 downward, a second screw 39 which passes through the second lever 35 and is fixed to the first lever 34, a second compression spring 39*a* which is installed around the circumferential surface of the second screw 39 and presses the second lever 35 downward, and first and second cam members 36 and 37 which support the first and second levers 34 and 35, respectively upward.

A torque around the hinge shaft 33*a* in a counterclockwise direction in FIG. 1 acts on the first and second levers 34 and 35 by the elastic forces of the first and second compression springs 38*a* and 39*a.* Therefore, the photosensitive belt 10, the transfer roller 31, and the fixing roller 32 can be moved to be in contact with each other. On the other hand, since the first and second cam members 36 and 37 each rotate, a predetermined amount, the photosensitive belt 10, the transfer roller 31, and the fixing roller 32 can contact each other or separate from each other. That is, when the first and second cam members 36 and 37 rotate in a clockwise direction, the first and second levers 34 and 35 are raised while overcoming the elastic forces of the first and second compression springs 38*a* and 39*a,* and the photosensitive belt 10, the transfer roller 31, and the fixing roller 32 separate from each other. In addition, when the first and second cam members 36 and 37 rotate in a counterclockwise direction, the first and second levers 34 and 35 are lowered by the elastic forces of the first and second compression springs 38*a* and 39*a,* and the photosensitive belt 10, the transfer roller 31, and the fixing roller 32 contact each other.

However, in the transfer unit configured as above, a relatively large driving force is required to pivot the first and second levers 34 and 35. For example, when the individual pressing forces between the photosensitive belt 10 and the transfer roller 31, and between the transfer roller 31 and the fixing roller 32 are 80 kgf, the first and second compression springs 38*a* and 39*a* each having an elastic force of 40 kgf are installed in pairs on the side shown in FIG. 1 and on an opposite side hidden by the shown springs 38*a* and 39*a*. On the other hand, while only the elastic force of the second compression springs 39*a,* i.e., 80 kgf acts on the second cam member 37, the summed elastic force of the first and second springs, i.e., 160 kgf acts on the first cam member 36. Therefore, there is a problem in which a greater force is required to cause the photosensitive belt 10, the transfer roller 31, and the fixing roller 32 to contact or separated from each other, and thus power consumption is high.

SUMMARY OF THE INVENTION

It is an objective of the present invention to provide a transfer unit of an electrophotographic printer in which the structure of the transfer unit is improved so that a photosensitive belt, a transfer roller, and a fixing roller can contact or separate from each other with a smaller force.

Accordingly, to achieve the above objective, there is provided a transfer unit of an electrophotographic printer, comprising: a base frame; a first lever which is pivotally installed at the base frame, and by which a transfer roller is supported, the transfer roller rotating while closely contacting a photosensitive belt and, to which an image on the photosensitive belt is transferred; a second lever which is pivotally installed at the base frame, and by which a fixing roller is supported, the fixing roller pressing a paper passing through between the transfer roller and the fixing roller against the transfer roller while rotating in contact with the transfer roller, and fixing the image on the transfer roller onto the paper; a first elastic biasing mechanism which elastically biases the first lever and the second lever so that the transfer roller and the fixing roller can be separated from each other; a second elastic biasing mechanism which elastically biases the first lever so that the transfer roller can separate from the photosensitive belt; and a wire one end of which is fixed to a winding gear rotatably installed at the base frame, and the other end of which is fixed to the first lever, and which is connected to the first lever and the second lever so that the transfer roller and the fixing roller, and the photosensitive belt approach each other while overcoming the elastic biasing forces of the first and second elastic biasing mechanisms.

BRIEF DESCRIPTION OF THE DRAWINGS

The above objective and advantage of the present invention will become more apparent by describing in detail preferred embodiments thereof with reference to the attached drawings, in which.

DETAILED DESCRIPTION OF THE PREFERRED EMBODIMENTS

Figure 1:
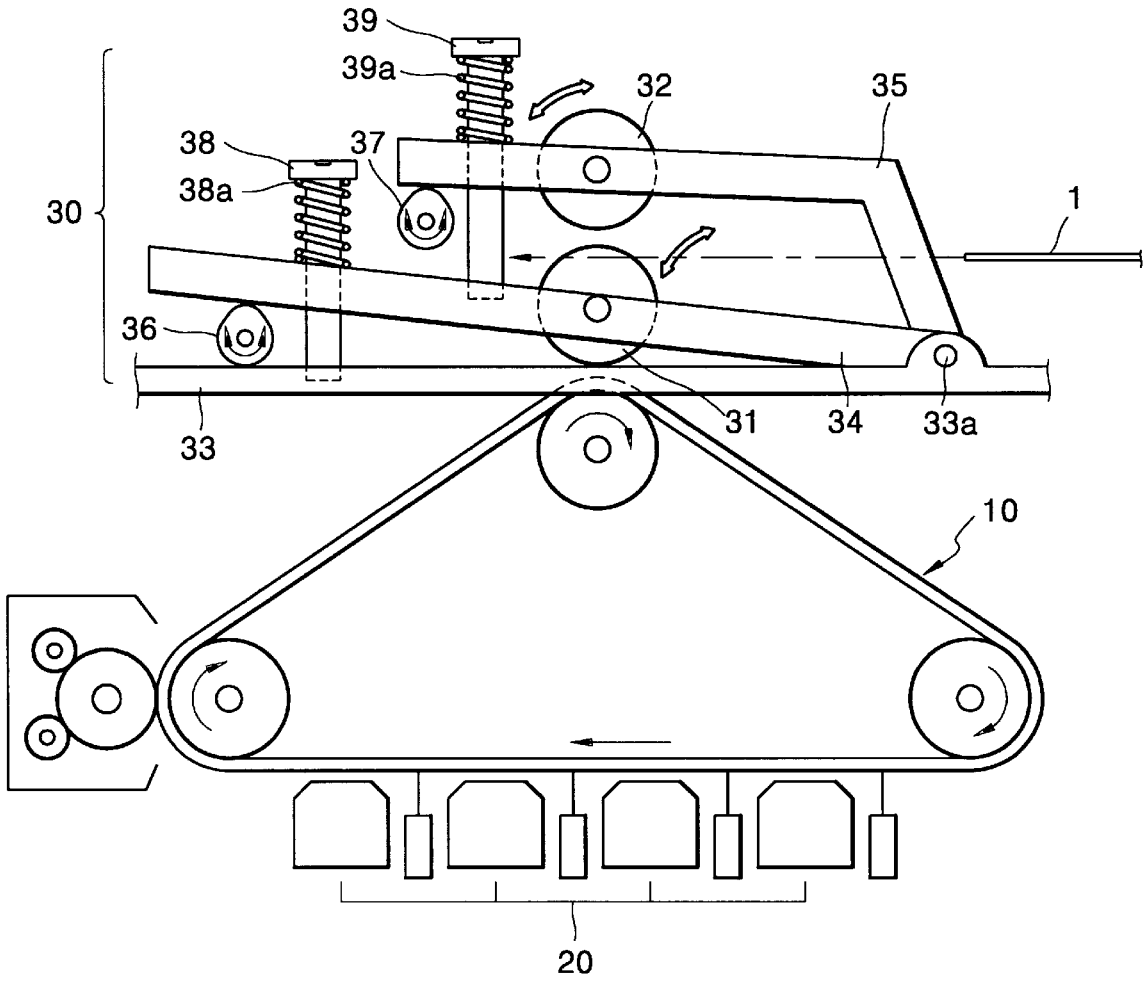
FIG.1 (PRIOR ART)
FIG. 1 is a schematic diagram illustrating the internal structure of an electrophotographic printer employing a conventional transfer unit.
Figure 2:
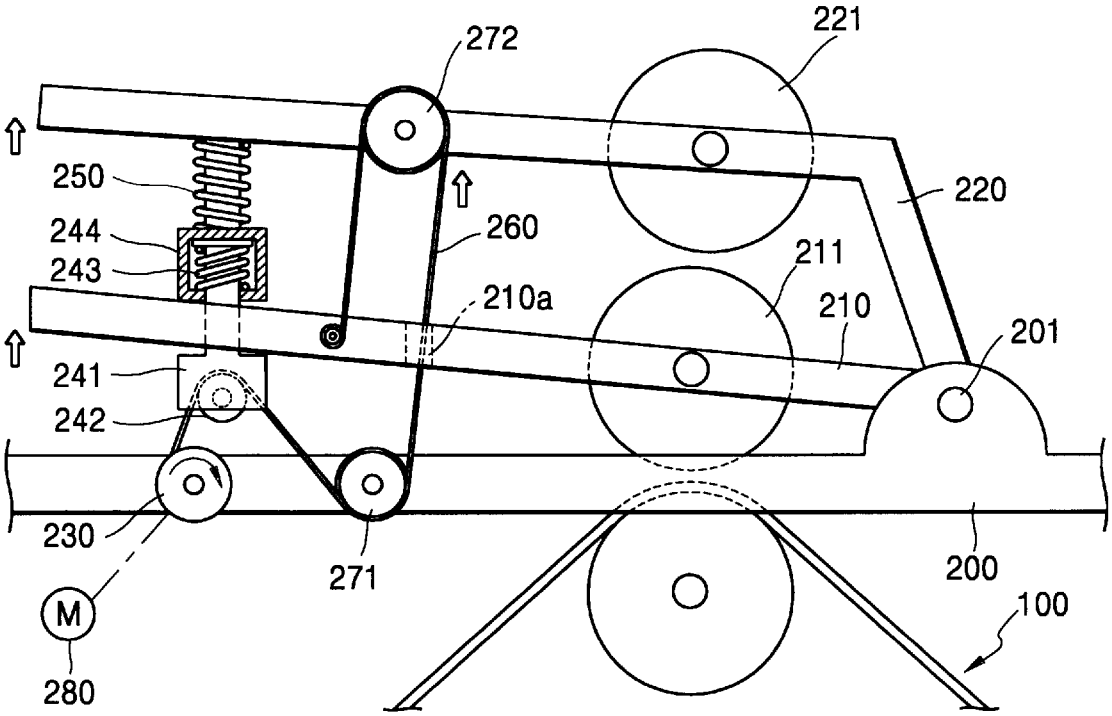
FIGS. 2 and 3 are schematic diagrams illustrating a transfer unit of an electrophotographic printer according to a preferred embodiment of the present invention.
Figure 3:
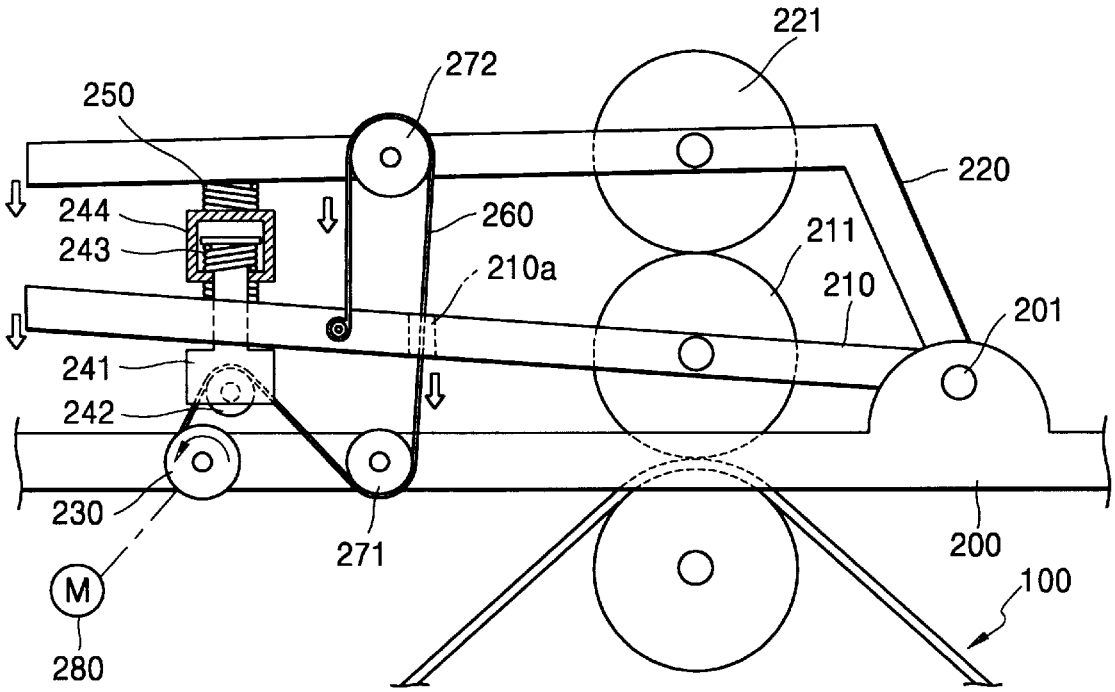

FIGS. 2 and 3 are schematic diagrams illustrating a transfer unit of an electrophotographic printer according to a preferred embodiment of the present invention, and in particular FIG. 2 shows the transfer unit when a transfer roller is separated from a photosensitive belt, and FIG. 3 shows the transfer unit when the transfer roller contacts the photosensitive belt.

Referring to FIGS. 2 and 3, first and second levers 210 and 220 are pivoted on a hinge shaft 201 provided at a base frame 200, a transfer roller 211 and a fixing roller 221 are installed at and supported by the first and second levers 210 and 220 respectively. Therefore, a photosensitive belt 100, the transfer roller 211, and the fixing roller 221 contact or separate from each other according to the pivoting movement of the first and second levers 210 and 220. In addition, the first and second levers 210 and 220 are subject to an elastic force in separating directions by a compression spring 250 (referred to as a first elastic member hereinafter) installed therebetween. Further, first and second pulleys 271 and 272 are rotatably installed at the first and second levers 210 and 220, respectively, and are connected by a wire 260 passing through a through hole 210*a* of the first lever 210. One end of the wire 260 is fixed to a winding gear 230 installed at the base frame 200, and the other end is fixed to the first lever 210. Here, the winding gear 230 can be rotated clockwise or counterclockwise by a motor 280. In addition, the wire 260 drapes over a pulley 242 installed at a bracket 241 between the winding gear 230 and the first pulley 271. The pulley 242 is supported by the bracket 241, and the bracket 241 passes through the first lever 210 and is installed to move vertically. In addition, the bracket 241 is subject to an upward elastic force of a compression spring 243 (referred to as a second elastic member hereinafter) housed in a case 244. The case 244 is fixed to the base frame 200. The bracket 241 biases the first lever 210 upward by the second elastic member 243.

When the motor 280 is operated so as to cause the photosensitive belt 100, the transfer roller 211, and the fixing roller 221 to contact each other as shown in FIG. 3, the winding gear 230 rotates in a counterclockwise direction in FIG. 3. Then, the wire 260 is wound around the winding gear 230, the first and second levers 210 and 220 are lowered toward the photosensitive belt 100 by the wire 260, and also the bracket 241 is lowered while overcoming the elastic force of the second elastic member 243. That is, when the wire 260 is wound by the winding gear 230, the first and second levers 210 and 220 pivot around the hinge shaft 201 counterclockwise, and consequently the photosensitive belt 100, the transfer roller 211, and the fixing roller 221 contact each other.

When the printing operation is finished, and the motor 280 is operated in a reverse direction so as to cause the photosensitive belt 100, the transfer roller 211, and the fixing roller 221 to separate from each other as shown in FIG. 2, the winding gear 230 is rotated clockwise. Then, the tension of the wire 260 is reduced while the wire 260 wound around the winding gear 230 is released from the winding gear 230, the gap between the first and second levers 210 and 220 is widened by the elastic force of the first elastic member 250, and the bracket 241 is raised by the elastic force of the second elastic member 243. Further, the bracket 241 pushes up the first lever 210 while being raised. Therefore, as the wire 260 is released from the winding gear 230, the photosensitive belt 100, the transfer roller 211, and the fixing roller 221 can be separated from each other.

On the other hand, in the above-described transfer unit of the present invention, the power required when the transfer roller 211 and the fixing roller 221 are caused to contact or separate from each other is greatly reduced in comparison with that required in the conventional structure. That is, since the wire 260 is arranged to run over the pulley 242, and the first and second pulleys 271 and 272, the same force can be obtained by a half power according to the principle of pulleys. For example, in order to establish a pressing force of 80 kgf between the transfer roller 211 and the fixing roller 221, a force of only 40 kgf is required since pulling forces act on both sides of the second pulley 272. Further, when a pair of the above structures each employing a wire are installed on a shown front side and a hidden rear side in FIGS. 2 and 3, a pressing force of 80 kgf can be obtained by applying a power of 20 kgf to each wire.

As described above, the transfer unit of an electrophotographic printer according to the present invention has an advantage in which the transfer roller 211 and the fixing roller 221 can be caused to contact or separate from each other with a power smaller than that required in the conventional art.

What is claimed is:

1. A transfer unit of an electrophotographic printer, comprising:

a base frame;

a first lever which is pivotally installed at the base frame, and by which a transfer roller is supported, the transfer roller rotating while closely contacting a photosensitive belt and to which an image on the photosensitive belt is transferred;

a second lever which is pivotally installed at the base frame, and by which a fixing roller is supported, the fixing roller pressing a paper passing through between the transfer roller and the fixing roller against the transfer roller while rotating in contact with the transfer roller, and fixing the image on the transfer roller onto the paper;

a first elastic biasing mechanism which elastically biases the first lever and the second lever so that the transfer roller and the fixing roller can be separated from each other;

a second elastic biasing mechanism which elastically biases the first lever so that the transfer roller can separate from the photosensitive belt; and a wire one end of which is fixed to a winding gear rotatably installed at the base frame, and an other end of which is fixed to the first lever, and which is connected to the first lever and the second lever so that the transfer roller and the fixing roller, and the photosensitive belt approach each other while overcoming the elastic biasing forces of the first and second elastic biasing mechanisms.

2. The transfer unit of an electrophotographic printer as claimed in claim 1, wherein the second elastic biasing mechanism comprises;

a bracket which passes through the first lever and is installed to be vertically movable;

a pulley rotatably installed at the bracket so that the wire can be draped over the pulley; and a compression spring for elastically biasing the first lever toward the second lever so that the bracket can raise the first lever.

3. The transfer unit of an electrophotographic printer as claimed in claim 2, wherein the second elastic biasing mechanism further comprises a case in which the compression spring and one end of the bracket are movably housed, and which is installed at the base frame to be disposed between the first and second levers.

4. The transfer unit of an electrophotographic printer as claimed in claim 3, wherein the first elastic biasing mechanism comprises a compression spring installed between the case and the second lever.

5. The transfer unit of an electrophotographic printer as claimed in claim 1, wherein the transfer unit further comprises first and second pulleys installed at the base frame and the second lever, respectively, so that the wire can be draped over the first and second pulleys.

* * * * *